US011208309B2

(12) United States Patent
Ehrismann et al.

(10) Patent No.: US 11,208,309 B2
(45) Date of Patent: Dec. 28, 2021

(54) DEVICE AND METHOD FOR CLOSING A BOTTLE WITH TORQUE MEASUREMENT

(71) Applicant: Krones AG, Neutraubling (DE)

(72) Inventors: Tobias Ehrismann, Burglengenfeld (DE); Markus Schoenfelder, Regensburg (DE)

(73) Assignee: Krones AG, Neutraubling (DE)

( * ) Notice: Subject to any disclaimer, the term of this patent is extended or adjusted under 35 U.S.C. 154(b) by 77 days.

(21) Appl. No.: 16/704,839

(22) Filed: Dec. 5, 2019

(65) Prior Publication Data

US 2020/0180927 A1 Jun. 11, 2020

(30) Foreign Application Priority Data

Dec. 5, 2018 (DE) ..... 102018221034.9

(51) Int. Cl.
*B67B 3/20* (2006.01)
*B67B 3/26* (2006.01)

(52) U.S. Cl.
CPC ..... *B67B 3/208* (2013.01); *B67B 3/206* (2013.01); *B67B 3/261* (2013.01)

(58) Field of Classification Search
CPC .. B67B 3/00; B67B 3/20; B67B 3/206; B67B 3/2073; B67B 3/208; B67B 3/2086; B67B 3/2093; B67B 3/26; B67B 3/261
USPC ..... 53/75, 317, 334, 485, 490
See application file for complete search history.

(56) References Cited

U.S. PATENT DOCUMENTS 4,364,218 A * 12/1982 Obrist ..... B67B 3/2086 53/331.5
4,614,077 A * 9/1986 Muto ..... B67B 3/208 53/317
4,939,890 A 7/1990 Peronek et al.
5,321,935 A * 6/1994 Spatz ..... B67B 3/26 53/490
6,679,026 B1 * 1/2004 Cirio ..... B67B 3/2033 53/317
8,001,748 B2 * 8/2011 Schulz ..... B67B 3/2093 53/471

(Continued)

FOREIGN PATENT DOCUMENTS

CN 101878179 A 11/2010
DE 4217461 A1 * 12/1993 ..... B67B 3/20

(Continued)

OTHER PUBLICATIONS

China National Intellectual Property Administration, Office Action and Search Report Issued in Application No. 201911211997.4, dated Mar. 3, 2021, 9 pages.

*Primary Examiner* — Hemant Desai
*Assistant Examiner* — Jacob A Smith
(74) *Attorney, Agent, or Firm* — McCoy Russell LLP

(57) ABSTRACT

The present disclosure relates to a device for holding a bottle to be closed, comprising a holding element for holding, in a rotationally fixed manner with respect to the holding element, a neck ring of the bottle to be closed, and a fastening element for fastening the holding element to a bottle closing device or to a bottle transport device, and having a torque sensor for detecting a torque acting between the holding element and the fastening element. Furthermore, the present disclosure discloses a device for closing a bottle and a method for closing a bottle.

15 Claims, 4 Drawing Sheets

(56) References Cited

U.S. PATENT DOCUMENTS

| | | | | |
|---|---|---|---|---|
| 2009/0255214 | A1* | 10/2009 | Schussler | B67B 3/2086 53/331.5 |
| 2011/0083405 | A1* | 4/2011 | Dewert | B67B 3/2033 53/490 |
| 2012/0039751 | A1* | 2/2012 | Shenberg | A61L 2/183 422/119 |
| 2012/0240519 | A1* | 9/2012 | Forestelli | B67B 3/261 53/284.5 |
| 2012/0311963 | A1* | 12/2012 | Fukuda | B67B 3/208 53/317 |
| 2015/0033667 | A1* | 2/2015 | Cirio | B65B 7/2842 53/329 |
| 2016/0031581 | A1* | 2/2016 | Gertlowski | B65C 9/06 198/793 |
| 2016/0272348 | A1* | 9/2016 | Itoh | B65B 7/2835 |
| 2018/0202802 | A1* | 7/2018 | Angres | G01L 5/24 |
| 2020/0025636 | A1* | 1/2020 | Caffa | G01L 5/24 |

FOREIGN PATENT DOCUMENTS

| | | | | |
|---|---|---|---|---|
| DE | 4217461 | A1 | 12/1993 | |
| DE | 9419402 | U1 | 2/1995 | |
| DE | 102007057284 | A1 * | 6/2009 | B67B 3/20 |
| DE | 102007057284 | A1 | 6/2009 | |
| EP | 2653436 | A1 | 10/2013 | |
| WO | 2009130657 | A1 | 10/2009 | |

* cited by examiner

DEVICE AND METHOD FOR CLOSING A BOTTLE WITH TORQUE MEASUREMENT

CROSS-REFERENCE TO RELATED APPLICATIONS

The present application claims priority to German Application No. 10 2018 221 034.9 entitled "DEVICE AND METHOD FOR CLOSING A BOTTLE WITH TORQUE MEASUREMENT", filed on Dec. 5, 2018. The entire contents of the above listed application are hereby incorporated by reference for all purposes.

FIELD OF THE INVENTION

The present disclosure relates to a device for holding a bottle to be closed, comprising a holding element for holding, in a rotationally fixed manner with respect to the holding element, a neck ring of the bottle to be closed, and a fastening element for fastening the holding element to a bottle closing device or to a bottle transport device. Furthermore, the disclosure relates to a device for closing a bottle and a method for closing a bottle.

PRIOR ART

A device of the generic kind for holding a bottle to be closed is known from EP 2 653 436 A1, especially for plastic bottles. A so-called spike plate is here used, which, while the cap is being screwed on, fixes the bottle in a rotationally fixed manner at a neck ring of the bottle by means of spikes provided on the spike plate. The spikes are arranged e.g. on the upper surface of the spike plate, and the lower surface of the neck ring is placed onto the spikes of the spike plate and, if necessary, the neck ring is pressed-on in the direction of the spikes.

Being able to apply a defined and constant closing torque is of advantage during the closing process. This will reduce the number of incorrectly closed containers. In order to obtain information on the torque applied to the closure, it is known to measure the current consumption of the drive that screws the caps onto the bottles.

However, friction effects, temperature influences and other factors, such as the application force acting in a perpendicular direction, may cause the closing torque to deviate significantly from the drive torque provided by the motor. This means that the current method does not allow to make any reliable and precise statements with respect to the torque actually acting on the closure.

DESCRIPTION OF THE INVENTION

It is the object of the present disclosure to overcome the above-mentioned drawbacks at least partially.

The device according to the present disclosure used for holding a bottle to be closed comprises a holding element for holding, in a rotationally fixed manner with respect to the holding element, a neck ring of the bottle to be closed, and a fastening element for fastening the holding element to a bottle closing device or to a bottle transport device, and is characterized by a torque sensor for detecting a torque acting between the holding element and the fastening element.

The device according to the present disclosure has the advantage that, during a closing process in the course of which a cap is screwed onto a bottle held by the holding element at a neck ring thereof, precise information with respect to the closing torque acting between the cap and the bottle is provided by detecting the torque between the holding element and the fastening element.

The holding element prevents during closing of a bottle (screwing-on of a cap) a rotation of the bottle relative to the holding element. For this purpose, the holding element may be configured e.g. in the form of the above described spike plate. According to another example, the neck ring of a bottle may be coupled with the holding element via a clamping mechanism of the holding element, so as to prevent relative rotation therebetween.

The device according to the present disclosure may be further developed as follows hereinafter.

The holding element and the fastening element may be interconnected by means of at least one connecting element and the torque acting between the holding element and the fastening element may thus be transmitted via the at least one connecting element.

The at least one connecting element can provide a torsionally flexible connection between the holding element and the fastening element. A torsionally flexible connection means that the connection between the holding element and the fastening element is configured such that a rotational displacement of the holding element with respect to the fastening element caused by an applied torque and the resultant deformation of the at least one connecting element provides a resilient restoring force or a counter torque. When a closing torque applied to the cap is reduced to zero again, the rotational displacement is reset to the initial position.

The at least one connecting element may comprise one or a plurality of webs between the holding element and the fastening element. These webs may in particular represent the only connection between the holding element and the fastening element. These webs can deform elastically and the degree of deformation (and of the resultant rotational displacement, respectively) can be used as a measure for the torque applied between the holding element and the fastening element.

The torque sensor may comprise a pointer element that is rotationally fixed with respect to the holding element, and a detection unit for detecting a deflection of the pointer element. This provides a possibility of scaling up the rotational displacement via the pointer element or the end portion thereof, so as to simplify the detection of the rotational displacement and render it more sensible.

The detection unit may be provided on the fastening element. In this way, the deflection caused by the rotation of the pointer element can be detected directly proportionally thereto.

According to another further development, the pointer element may comprise a magnetic element, and the detection unit may comprise a magnetic field sensor.

Finally, according to a further development of the present disclosure, also the perpendicularly acting press-on force, which acts perpendicularly on the bottle during the screw-on process, is measured. For this purpose, either a separate sensor, by way of example, may be arranged e.g. between the spikes and dimensioned such that it will be able to measure the press-on force, or e.g. the pointer element may be configured such that it will also be able to measure perpendicularly acting forces.

The disclosure also provides a device for closing a bottle, which comprises a device according to the present disclosure used for holding the bottle to be closed, or one of the above-mentioned further developments, and a control unit for controlling a closing torque acting on a cap to be screwed onto the bottle, based on a signal outputted by the torque sensor.

The control unit may be configured to reduce the closing torque, when the signal reaches or exceeds a predetermined limit value. In this way, a defined closing torque can be provided, which, on the one hand, is not too high so as to avoid "overtightening" of the cap and, on the other hand, not too low so as to avoid insufficient closing of the bottle by the cap.

The method according to the present disclosure used for closing a bottle comprises the following steps: holding, by means of a holding element, a neck ring of the bottle to be closed, the holding taking place in a rotationally fixed manner with respect to the holding element, and the holding element being fastened to a bottle closing device by a fastening element; and the method is characterized by the step of detecting a torque which acts between the holding element and the fastening element.

The advantages of the method according to the present disclosure correspond to those of the device according to the present disclosure or the further developments of this device; hence, these advantages are not repeated here once more, but the above statements are referred to.

The method according to the present disclosure may be further developed as follows hereinafter.

The further step of controlling a closing torque acting on a cap to be screwed onto the bottle, based on a signal outputted by a torque sensor, which detects the torque, may be provided.

The controlling may comprise a reduction of the closing torque, when the signal reaches or exceeds a predetermined limit value.

The detection of the torque may comprise detecting a rotational displacement of the holding element with respect to the fastening element.

The detection of the rotational displacement may comprise detecting the change of position of a pointer element arranged on the holding element.

The detection of the change of position of the pointer element may comprise detecting a magnetic field of a magnetic element arranged on the pointer element by means of a magnetic field sensor arranged on the holding element.

Further features and exemplary embodiments as well as advantages of the present disclosure will be explained in more detail hereinafter making reference to the drawings. It goes without saying that this embodiment cannot exhaust the entire scope of the present disclosure. In addition, it goes without saying that some of the features or all the features described hereinafter may also be combined with one another in some other way.

EMBODIMENTS

Figure 1A:
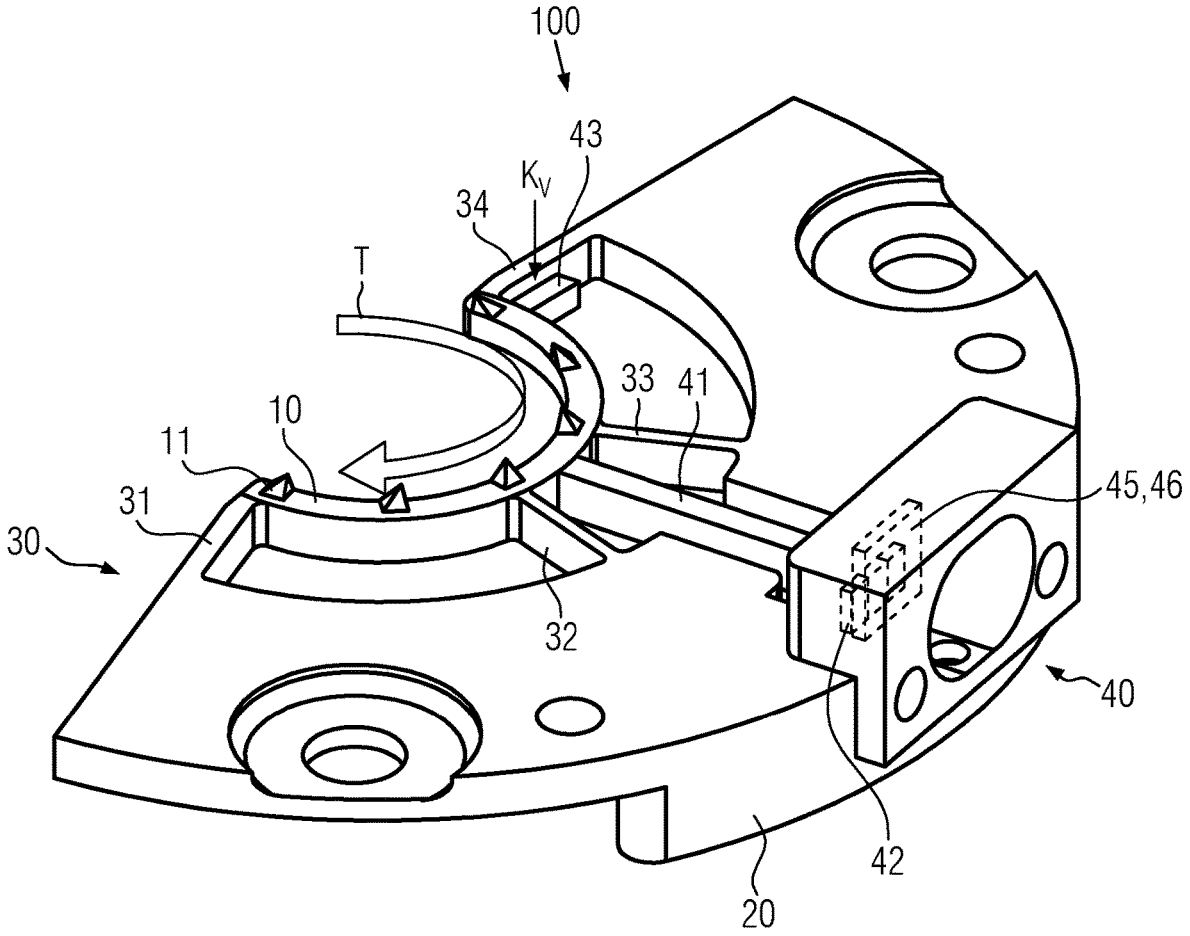
FIG. 1A and FIG. 1B show an embodiment of the device according to the present disclosure used for holding a bottle to be closed.
Figure 1B:
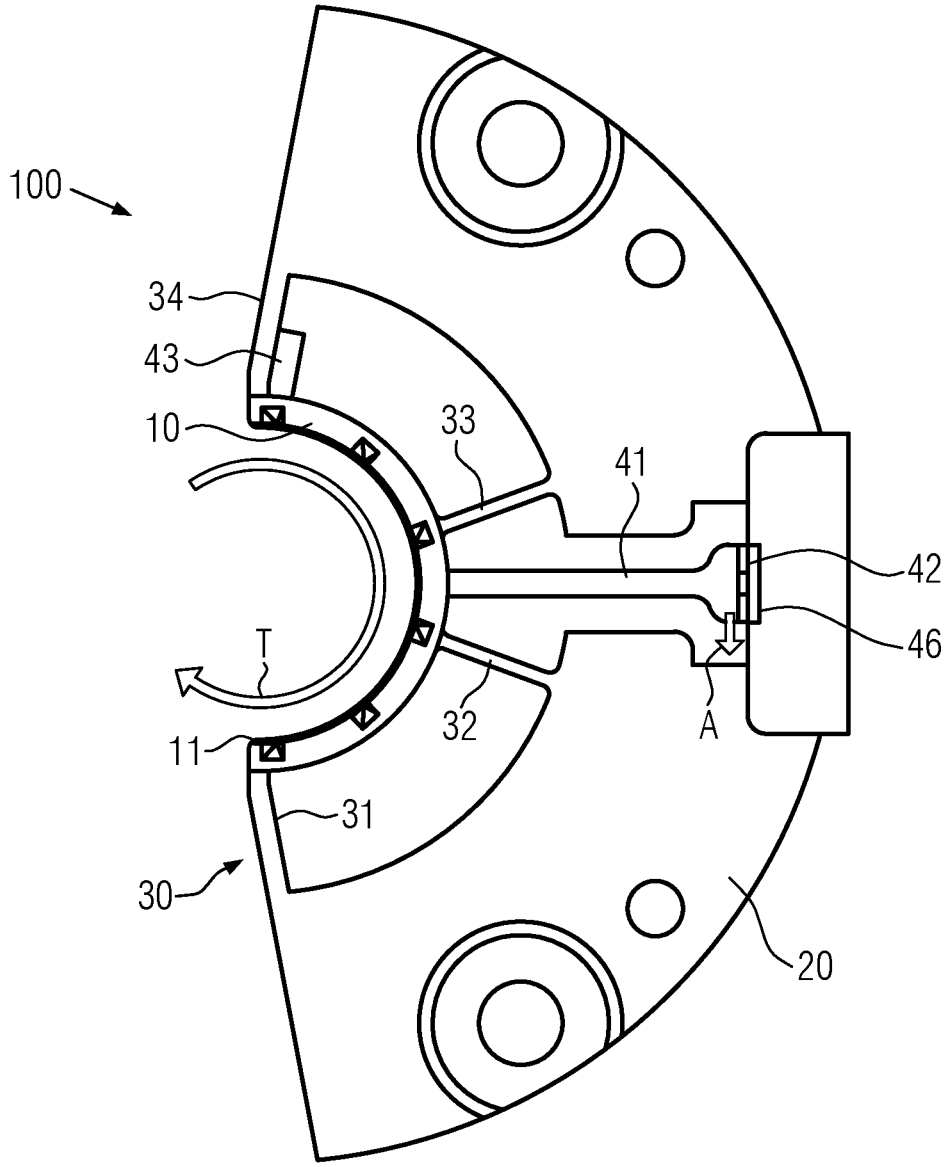
Figure 2:
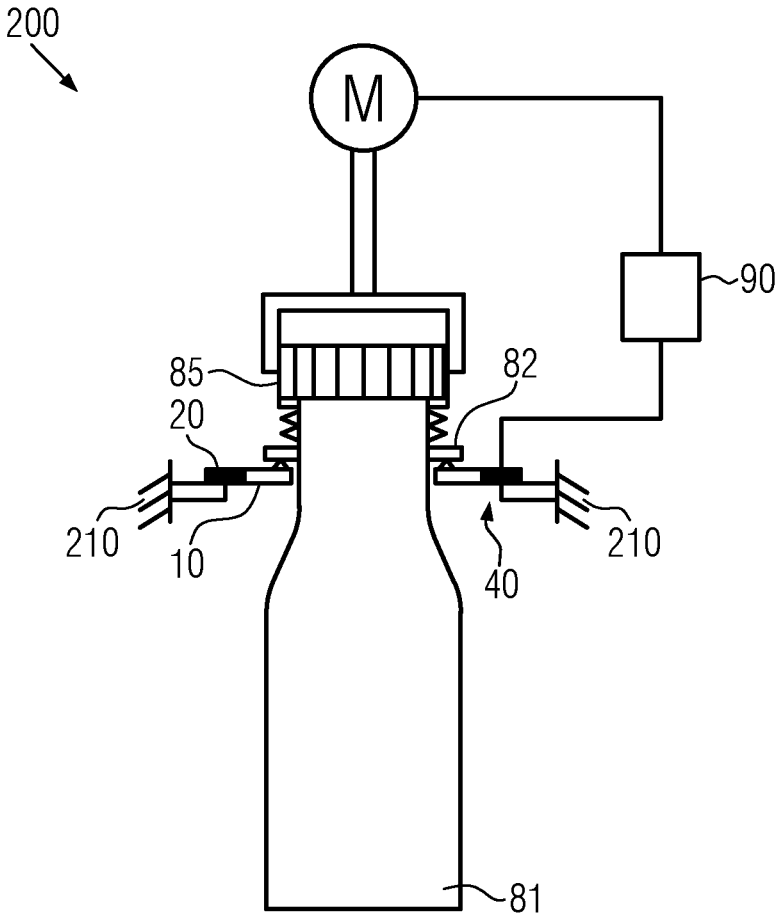
FIG. 2 shows an embodiment of the device according to the present disclosure used for closing a bottle.

The reference numerals indicated relate to all the figures, so that like reference numerals represent like components. FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. FIG. 1A and FIG. 1B are shown approximately to scale, though other relative dimensions may be used.

FIG. 1A and FIG. 1B show an embodiment of the device according to the present disclosure used for holding a bottle to be closed.

The exemplary device 100 according to the present disclosure used for holding a bottle to be closed comprises a holding element 10 and a fastening element 20 for fastening the holding element 10 to a bottle closing device or to a bottle transport device. The holding element 10 serves to hold a neck ring of the bottle to be closed, the holding being carried out in a rotationally fixed manner with respect to the holding element 10. In addition, the device 100 according to the present disclosure comprises a torque sensor 40 for detecting a torque acting between the holding element 10 and the fastening element 20.

The holding element 10 and the fastening element 20 are interconnected by means of at least one connecting element 30, the torque acting between the holding element 10 and the fastening element 20 being transmitted exclusively via the at least one connecting element 30.

A torque T (direction of arrow) applied to the holding element 10 that is generated due to a closing torque, which is applied to a screwed-on cap, and transmitted to the holding element 10 via the neck ring of the bottle also acts between the holding element 10 and the fastening element 20.

The at least one connection element 30 provides a torsionally flexible connection between the holding element 10 and the fastening element 20. The at least one connecting element 30 comprises one or a plurality of webs 31, 32, 33, 34 (in the present example the four webs 31, 32, 33, 34) between the holding element 10 and the fixing element 20.

The torque sensor 40 comprises a pointer element 41 that is rotationally fixed with respect to the holding element 10 and a detection unit 45 for detecting a deflection A of the pointer element, the detection unit 45 being provided on the fastening element 20. In this embodiment, the pointer element 41 comprises a magnetic element 42, and the detection unit 45 comprises a magnetic field sensor 46.

The holding element 10, the fastening element 20 and the webs 31, 32, 33, 34 may be made of metal and formed integrally with one another in the present embodiment. Furthermore, additionally or alternatively, also the pointer element 41 may be formed integrally with the holding element 10. However, the pointer element 41 may also be glued to or screwed onto the holding element 10.

The holding element 10 prevents a rotation of the bottle relative to the holding element 10 during closing of a bottle (screwing on of a cap). In the present embodiment, the holding element 10 is exemplarily configured as a so-called spike plate and has pointed elements 11 (spikes) on the upper surface of the holding element, which interact with a lower surface of a neck ring of a bottle made of plastic (press themselves into it) and prevent the bottle from rotating relative to the holding element 10. According to another example, the neck ring of a bottle may be coupled to the holding element via a clamping mechanism of the holding element so as to prevent relative rotation.

In FIG. 1B a force sensor 43 is additionally indicated, which is here arranged between the spikes 11 in such a way that it will be able to measure the force $K_v$ acting in a vertical direction during the screw-on process. This sensor could also be arranged at other suitable points and is not limited to the form according to the embodiment shown. However, it could e.g. also be integrated in the pointer element 41 in the case of this embodiment, i.e. the pointer element could e.g. be provided with strain gauges, which are attached to the upper and/or lower surface thereof and which could be able to detect a downward deflection of the pointer element.

FIG. 2 shows an embodiment of the device according to the present disclosure used for closing a bottle.

This embodiment of the device 200 according to the present disclosure used for closing a bottle comprises a device 100 for holding the bottle to be closed according to the embodiment shown in FIG. 1 and a control unit 90 for controlling a closing torque acting on a cap to be screwed onto the bottle, based on a signal outputted by the torque sensor 40 to the control unit 90.

The bottle body 81 to be closed with a cap 85 is held at the neck ring 82 in a rotationally fixed manner by means of the holding element 10. The bottom of the bottle body 81 may here especially be free, i.e. no other supporting measures are taken, so that the bottle body is exclusively held at the neck ring 82.

The holding element 10 is fastened to a component 210 of the bottle closing device 200 by means of a fastening element 20.

The control unit 90 is here configured to reduce, when the signal of the torque sensor 40 reaches or exceeds a predetermined limit value, the closing torque of a motor M acting on the cap 85. In this way, a defined closing torque is provided so that an excessively high closing torque and a possibly resulting damage to the thread on the cap 85 and/or the bottle neck will be avoided. In addition, also an insufficient closing torque can be avoided so as to avoid insufficient tightness of the cap.

Figure 3:
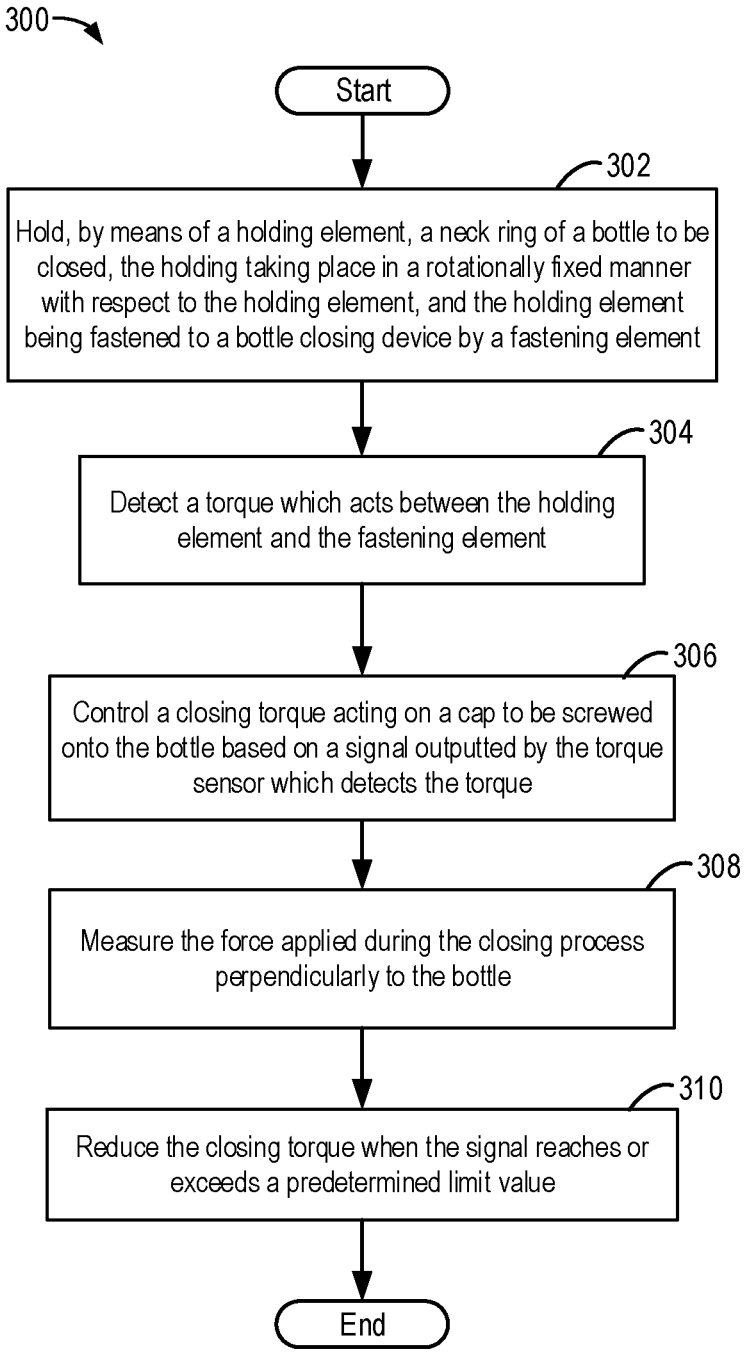
FIG. 3 shows a flow chart of a method in accordance with at least one example of the present disclosure.

Turning now to FIG. 3, FIG. 3 shows a flow chart of a method 300 in accordance with at least one example of the present disclosure for closing a bottle.

The control methods and routines disclosed herein may be stored as executable instructions in non-transitory memory and may be carried out by a control unit (such as control unit 90) in combination with the various sensors (such as torque sensor 40) and actuators (such as motor M). The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the control unit, where the described actions are carried out by executing the instructions in a system including the various components in combination with the control unit.

Looking now to method 300, step 302 of method 300 may include holding, by means of a holding element, a neck ring of the bottle to be closed, the holding taking place in a rotationally fixed manner with respect to the holding element, and the holding element being fastened to a bottle closing device by a fastening element, and detecting a torque which acts between the holding element and the fastening element at step 304. In at least one example, detecting the torque comprises detecting a rotational displacement of the holding element with respect to the fastening element.

Following step 304, method 300 may include controlling a closing torque acting on a cap to be screwed onto the bottle based on a signal outputted by a torque sensor which detects the torque at step 306. In at least one example, the force applied during the closing process perpendicularly to the bottle to be closed may be measured at step 308. Additionally or alternatively, method 300 may include detecting a rotational displacement of the holding element with respect to the fastening element by detecting a change of position of a pointer element arranged on the holding element at step 310. For example, detecting the change of position of the pointer element may comprise detecting a magnetic field of a magnetic element arranged on the pointer element by means of a magnetic field sensor arranged on the holding element. At step 312 of method 300, the controlling may include reducing the closing torque when the signal reaches or exceeds a predetermined limit value. Following step 312, method 300 may end.

In summary, provided herein is an intelligent spike plate (comprising the holding element 10, the fastening element 20, the torque sensor 40) that has a sensor system which is able to detect the torque actually acting on the closure. Due to the force exerted by the closing head, the spike plate deforms elastically via the webs in the range of a few hundredths of a millimeter. By means of a pointer, this deformation is scaled to a dimension that can be detected by a sensor. At the end of the pointer, a magnetic target is provided. The sensor, which detects the deformation, is located in opposed relationship with this magnetic target. The intelligent spike plate provides a feedback variable, viz. the torque acting on the closure. This feedback variable can then be used in a control loop to adjust the motor-side torque during the closing process in such a way that the torque provided at the closure will be precisely the desired torque and will be constant throughout the closing process.

It is noted that the embodiments described are only of an exemplary nature.

The invention claimed is:

1. A device for holding a bottle to be closed, comprising:
a holding element for holding, in a rotationally fixed manner with respect to the holding element, a neck ring of the bottle to be closed; and
a fastening element for fastening the holding element to a bottle closing device or to a bottle transport device; and
a torque sensor for detecting a torque acting between the holding element and the fastening element;
wherein the torque sensor comprises:
a pointer element that is rotationally fixed with respect to the holding element; and
a detection unit for detecting a deflection of the pointer element.

2. The device according to claim 1, wherein the holding element and the fastening element are interconnected by means of at least one connecting element and the torque acting between the holding element and the fastening element is transmitted via the at least one connecting element.

3. The device according to claim 2, wherein the at least one connecting element provides a torsionally flexible connection between the holding element and the fastening element.

4. The device according to claim 2, wherein the at least one connecting element comprises one or a plurality of webs between the holding element and the fastening element.

5. The device according to claim 1, wherein the detection unit is provided on the fastening element.

6. The device according to claim 1, wherein the pointer element comprises a magnetic element, and the detection unit comprises a magnetic field sensor.

7. A device for closing a bottle, comprising:
a device for holding the bottle to be closed according to claim 1; and
a control unit for controlling a closing torque acting on a cap to be screwed onto the bottle based on a signal outputted by the torque sensor.

8. The device according to claim 7, wherein the control unit is configured to reduce the closing torque when the signal reaches or exceeds a predetermined limit value.

9. The device according to claim 7, wherein a sensor is provided which measures a force acting in a vertical direction on the bottle undergoing the screw-on process.

10. A method for closing a bottle, comprising the following steps:
holding, by means of a holding element, a neck ring of the bottle to be closed, the holding taking place in a rotationally fixed manner with respect to the holding element, and the holding element being fastened to a bottle closing device by a fastening element; and
detecting a torque which acts between the holding element and the fastening element;
wherein detecting the torque comprises detecting a rotational displacement of the holding element with respect to the fastening element.

11. The method according to claim 10, further comprising the step of:
controlling a closing torque acting on a cap to be screwed onto the bottle based on a signal outputted by a torque sensor which detects the torque.

12. The method according to claim 11, wherein the controlling comprises a reduction of the closing torque when the signal reaches or exceeds a predetermined limit value.

13. The method according to claim 10, wherein detecting the rotational displacement comprises detecting the change of position of a pointer element arranged on the holding element.

14. The method according to claim 13, wherein detecting the change of position of the pointer element comprises detecting a magnetic field of a magnetic element arranged on the pointer element by means of a magnetic field sensor arranged on the holding element.

15. The method according to claim 10, wherein a force applied during the closing process perpendicularly to the bottle to be closed is measured.

* * * * *